US011355889B2

(12) United States Patent
Bergner et al.

(10) Patent No.: US 11,355,889 B2
(45) Date of Patent: Jun. 7, 2022

(54) COVER ASSEMBLY WITH AT LEAST ONE IMPEDANCE CONTROL STRUCTURE

(71) Applicants: TE Connectivity Germany GmbH, Bensheim (DE); TE Connectivity India Private Limited, Karnataka (IN)

(72) Inventors: Bert Bergner, Rimbach (DE); Sundareshan M D, Karnataka (IN); Gururaj A. Hiremath, Karnataka (IN)

(73) Assignees: TE Connectivity Germany GmbH, Bensheim (DE); TE Connectivity India Private Limited, Karnataka (IN)

( * ) Notice: Subject to any disclaimer, the term of this patent is extended or adjusted under 35 U.S.C. 154(b) by 0 days.

(21) Appl. No.: 17/004,539

(22) Filed: Aug. 27, 2020

(65) Prior Publication Data

US 2021/0066858 A1 Mar. 4, 2021

(30) Foreign Application Priority Data

Aug. 27, 2019 (EP) ..... 19193937

(51) Int. Cl.

| | |
|---|---|
| ***H01R 13/6474*** | (2011.01) |
| ***H01R 13/04*** | (2006.01) |
| ***H01R 13/422*** | (2006.01) |
| ***H01R 13/6581*** | (2011.01) |

(52) U.S. Cl.

CPC ..... *H01R 13/6474* (2013.01); *H01R 13/04* (2013.01); *H01R 13/422* (2013.01); *H01R 13/6581* (2013.01)

(58) Field of Classification Search

CPC .. H01R 13/6474; H01R 13/04; H01R 13/422; H01R 13/6581; H01R 13/648; H01R 13/6485

USPC ..... 439/92

See application file for complete search history.

(56) References Cited

U.S. PATENT DOCUMENTS

| | | | | |
|---|---|---|---|---|
| 6,203,369 | B1 * | 3/2001 | Feldman | H01R 24/40 439/579 |
| 7,004,793 | B2 * | 2/2006 | Scherer | H01R 13/6592 439/607.11 |
| 7,722,394 | B2 * | 5/2010 | Feldman | H01R 13/4223 439/578 |
| 7,731,528 | B2 * | 6/2010 | Feldman | H01R 13/6592 439/578 |
| 7,744,403 | B2 * | 6/2010 | Barr | H01R 13/6598 439/499 |
| 9,608,590 | B2 * | 3/2017 | Hamner | H01B 11/002 |
| 10,103,498 | B2 * | 10/2018 | Maesoba | H01R 13/516 |
| 10,283,891 | B2 * | 5/2019 | Maesoba | H01R 13/65918 |

(Continued)

OTHER PUBLICATIONS

Partial European Search Report, dated Feb. 20, 2020, 14 pages.
Extended European search report dated Jul. 20, 2021 in Appln. No. 19193937.0-1201, 13 pp.

*Primary Examiner* — Peter G Leigh
(74) *Attorney, Agent, or Firm* — Barley Snyder

(57) ABSTRACT

A cover assembly includes a protective cover having an impedance control structure and a plurality of electrical conductors conducting electrical signals of a high-frequency data transmission. The electrical conductors extend through the protective cover in a transmission direction and are overlappingly bonded to each other at a bond location located within the protective cover. The impedance control structure adjusts an impedance of the bond location to a predefined value.

15 Claims, 11 Drawing Sheets

(56) References Cited

U.S. PATENT DOCUMENTS

| | | | | |
|---|---|---|---|---|
| 10,297,932 | B2 * | 5/2019 | Maesoba | H01R 9/0518 |
| 10,305,202 | B2 * | 5/2019 | Maesoba | H01R 13/422 |
| 2019/0006785 | A1 * | 1/2019 | Maesoba | H01R 13/639 |
| 2019/0157809 | A1 * | 5/2019 | Maesoba | H01R 13/6581 |
| 2019/0252806 | A1 * | 8/2019 | Maesoba | H01R 13/659 |

* cited by examiner

COVER ASSEMBLY WITH AT LEAST ONE IMPEDANCE CONTROL STRUCTURE

CROSS-REFERENCE TO RELATED APPLICATION

This application claims the benefit of the filing date under 35 U.S.C. § 119(a)-(d) of European Patent Application No. 19193937.0, filed on Aug. 27, 2019.

FIELD OF THE INVENTION

The present invention relates to a cover assembly and, more particularly, to a cover assembly for the protection of a bond between electrical conductors of a high-frequency data transmission line.

BACKGROUND

In the field of data transmission, transmission lines usually consist of multiple components such as connectors, cables, wires, receptacles, and the like. These transmission line components are interconnected in order to establish the necessary signal channel. Said interconnections can be realized through a connection device, e.g. a plug and socket mechanism, or a permanent bond. The connection device needs to provide for a reliable electrical contact between the transmission line components. In case of permanent bonds, a reinforcement is further provided, surrounding the permanent bond to increase the mechanical stability of the permanent bond.

In applications where high-frequency data transmission is required, the connection device and the reinforcement themselves may have a negative influence on the properties of the signal channel, which deteriorates the signal quality and transmission performance, respectively.

SUMMARY

A cover assembly includes a protective cover having an impedance control structure and a plurality of electrical conductors conducting electrical signals of a high-frequency data transmission. The electrical conductors extend through the protective cover in a transmission direction and are overlappingly bonded to each other at a bond location located within the protective cover. The impedance control structure adjusts an impedance of the bond location to a predefined value.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
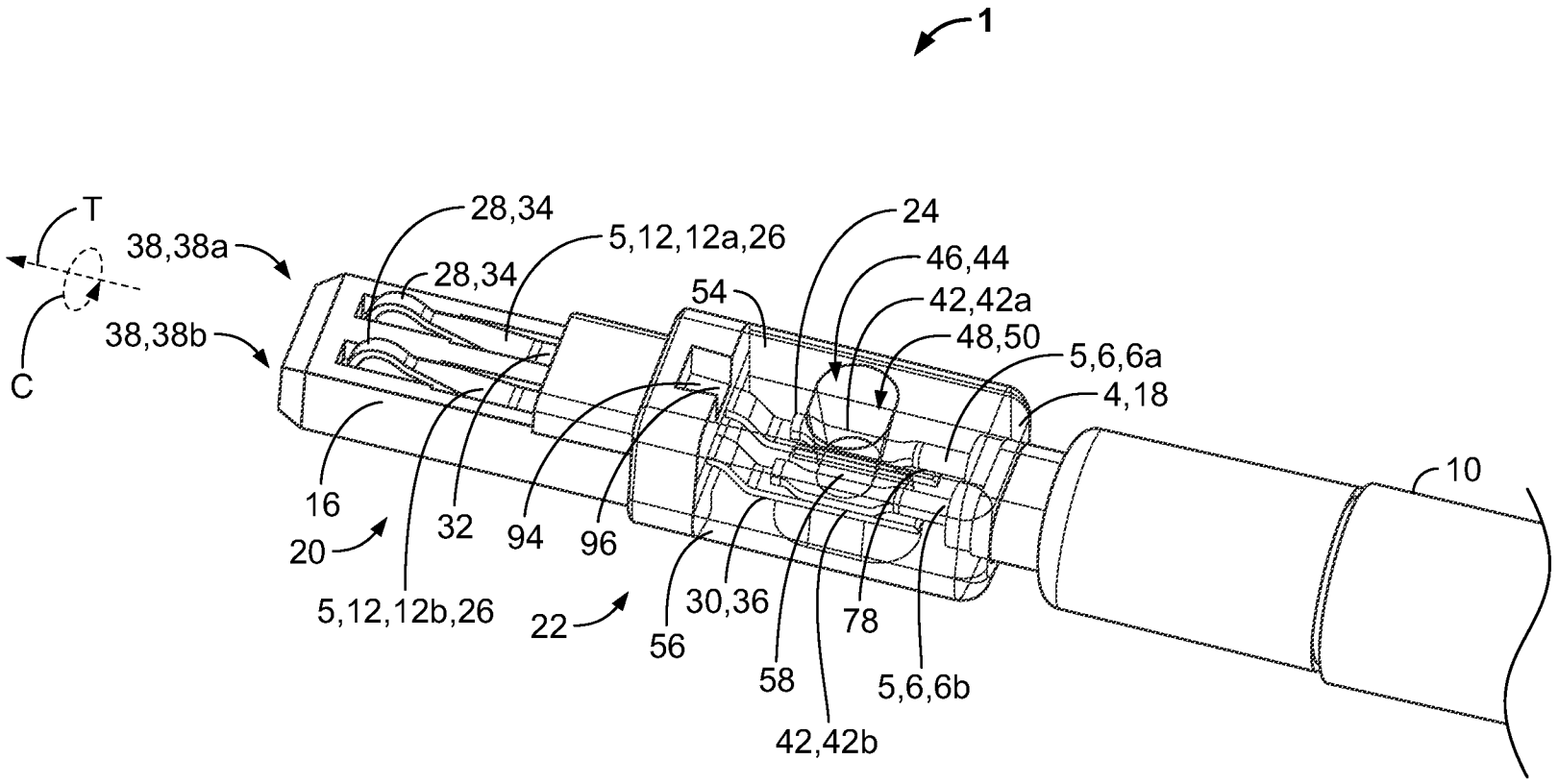
FIG. 1 is a partially transparent perspective view of a cover assembly according to an embodiment with a shielded cable.

In the following, exemplary embodiments of the invention are described with reference to the drawings. The shown and described embodiments serve explanatory purposes only. The combination of features shown in the embodiments may be changed according to the description. For example, a feature which is not shown in an embodiment but described may be added, if the technical effect associated with this feature is beneficial for a particular application. Vice versa, a feature shown as part of an embodiment may be omitted if the technical effect associated with this feature is not needed in a particular application. In the drawings, elements that correspond to each other with respect to function and/or structure have been provided with the same reference numeral.

Figure 8:
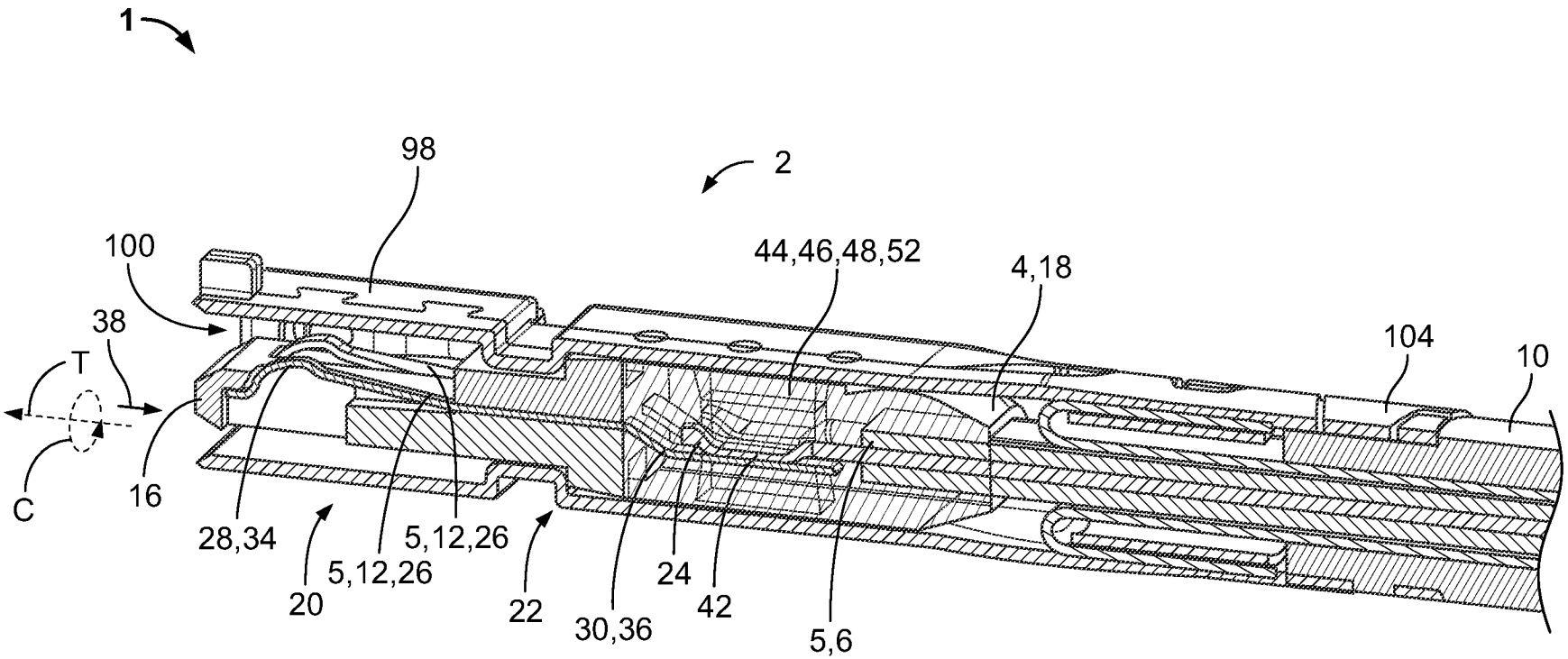
FIG. 8 is a sectional perspective view of a connector according to an embodiment.
Figure 9:
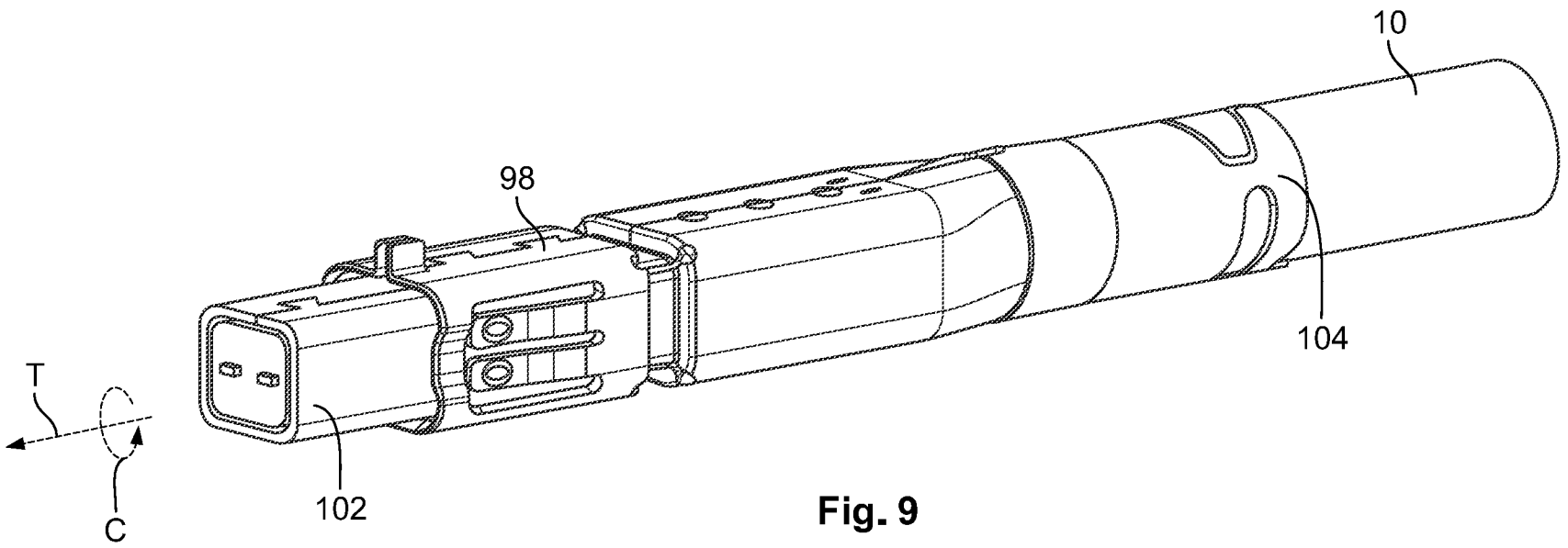
FIG. 9 is a perspective view of the connector of FIG. 8 and a mating connector.
Figure 10:
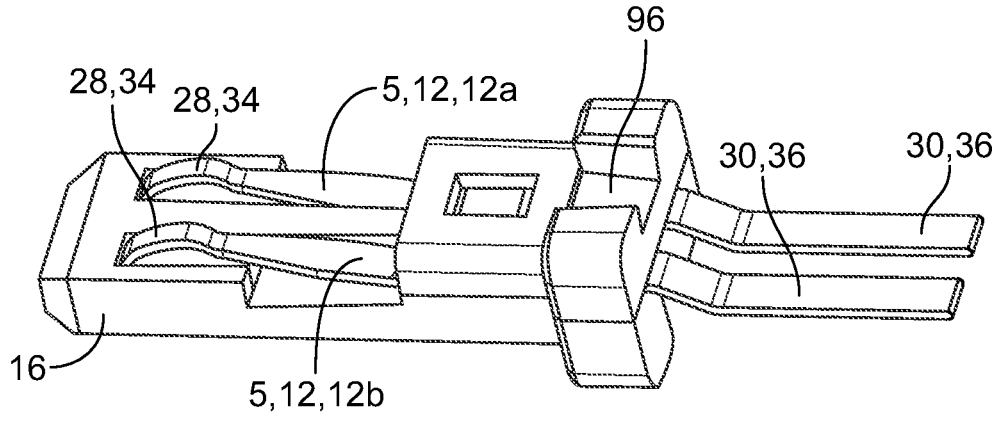
FIG. 10 is a perspective view of a contact carrier according to an embodiment.
Figure 11:
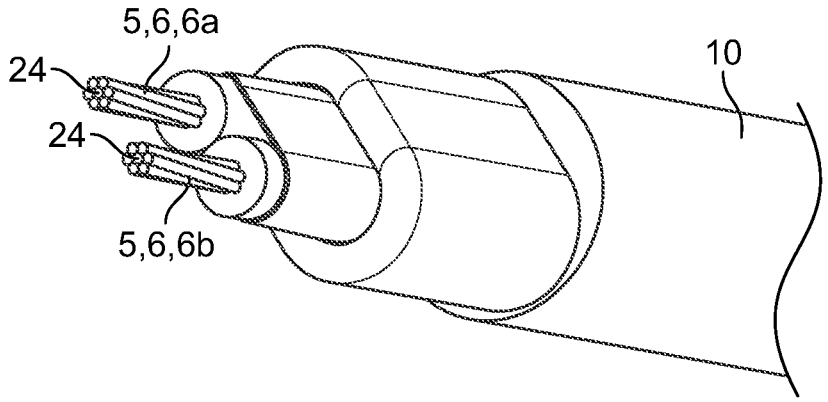
FIG. 11 is a perspective view of a shielded electrical cable according to an embodiment.
Figure 12:
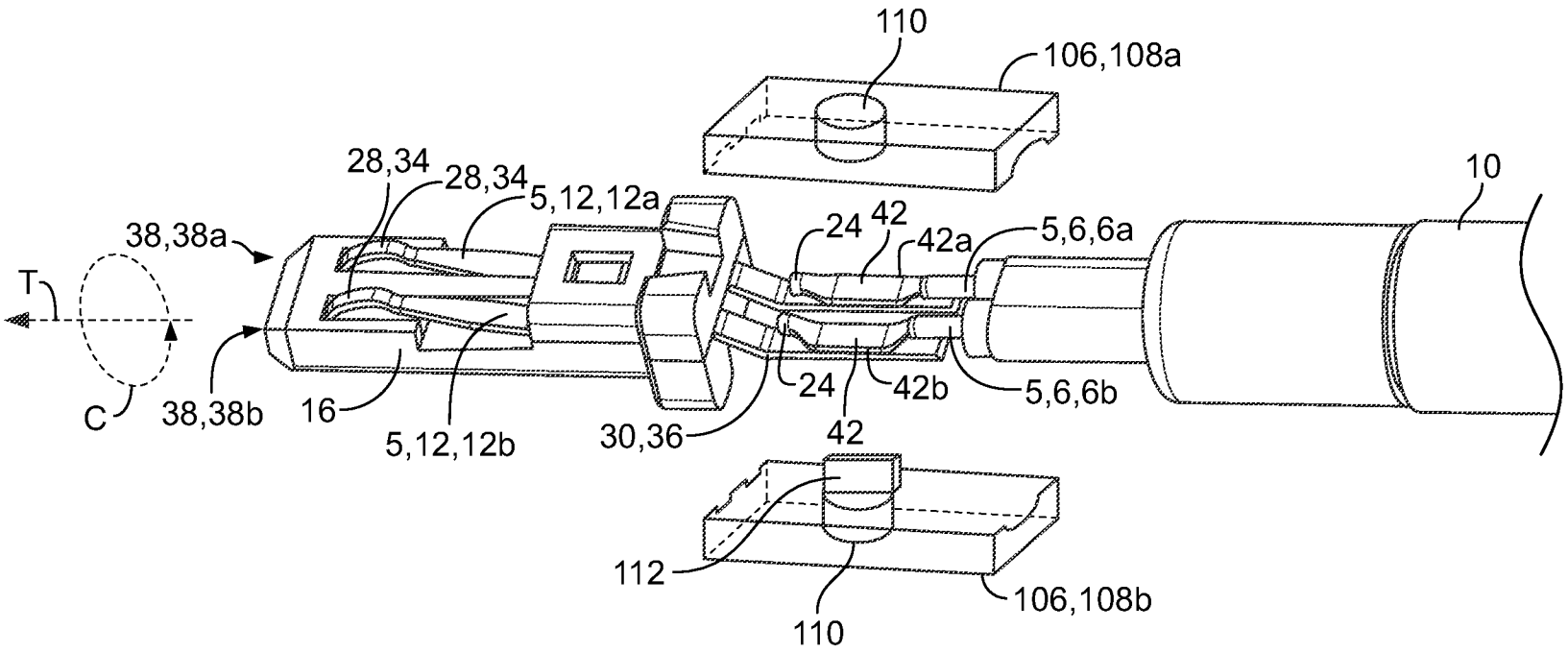
FIG. 12 is an exploded perspective view of a contact carrier, a shielded electrical cable, and a cast according to an embodiment.

First, the structure of a cover assembly 1 according to the present invention is explained with reference to the exemplary embodiments shown in FIGS. 1 to 7. FIGS. 8 and 9 are used for explaining the structure of a connector 2 according to the present invention. FIGS. 10 to 12 are used for explaining the method according to the present invention.

Figure 2:
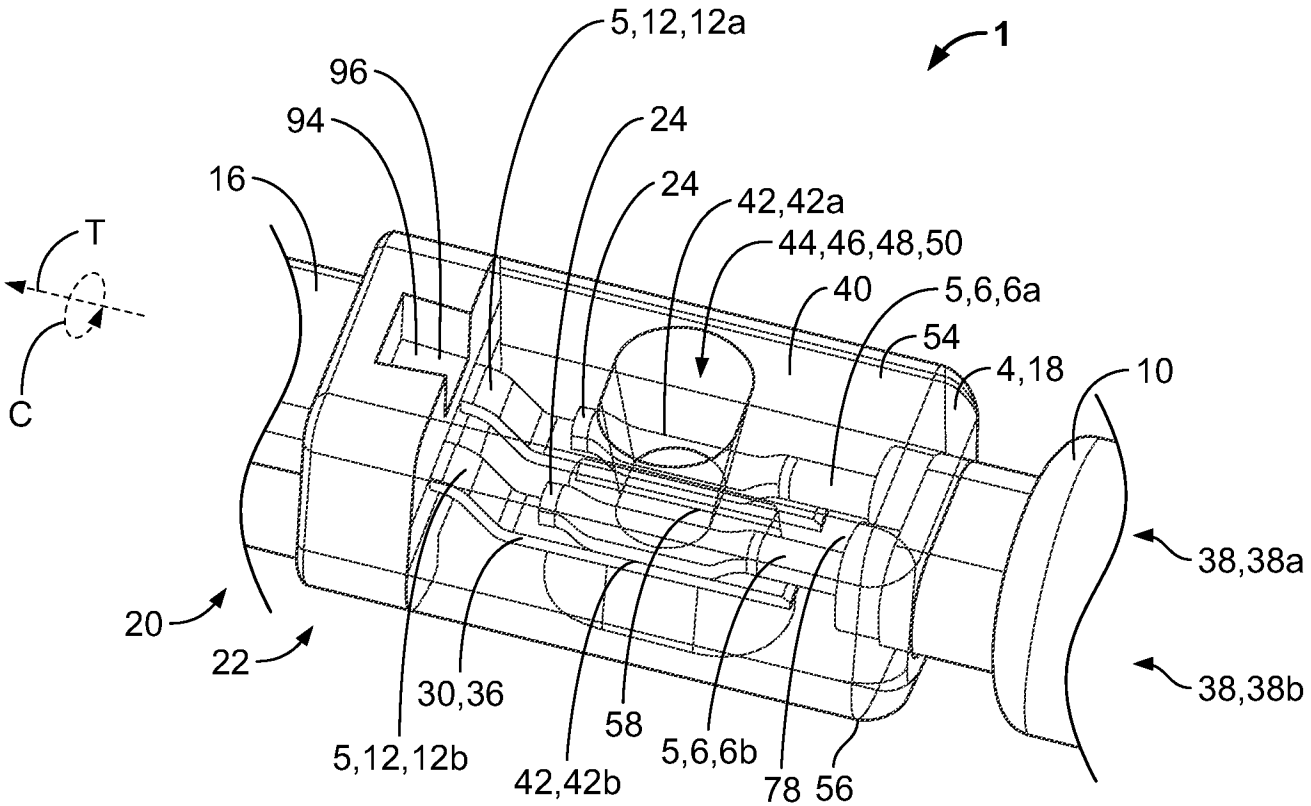
FIG. 2 is a partially enlarged schematic view of FIG. 1.

The cover assembly 1, as shown in the embodiment of FIGS. 1 and 2, includes a protective cover 4 shown in a transparent depiction. The cover assembly 1 includes a first wire 6*a* of a shielded electric cable 10, a second wire 6*b* of the same shielded electric cable 10, a first contact element 12*a* of a connector 2, a second contact element 12*b* of the same connector 2, and a contact carrier 16.

The cover assembly 1, as shown in FIGS. 1 and 2, includes a plurality of electrical conductors 5 for conducting electrical signals of, for example, a high-frequency data transmission. The plurality of electrical conductors 5 include the wires 6 and the contact elements 12. In the shown embodiment, one pair of electrical conductors 5 is the first wire 6*a* and the first contact element 12*a*. Another pair of electrical conductors 5 is the second wire 6*b* and the second contact element 12*b*.

The protective cover 4 is a substantially cuboid part made of an insulation material with a relative permittivity higher than air. In an embodiment, the high permittivity insulation material for the protective cover 4 is a material with a relative permittivity in a range between 9 and 10. An insulation material with incorporated ceramic powder may be used as the high permittivity insulation material for the protective cover 4.

More particularly, the protective cover 4 may be an overmolded part 18, as shown in the embodiments of FIGS. 1 to 4. In an embodiment, the overmold may exceed over a part of each of the at least two electrical conductors 5. More particularly, the at least two electrical conductors 5 may be at least partly embedded within the overmold. This embodiment allows the protective cover 4 to be manufactured through an automated low-pressure overmolding process. The usage of a high permittivity insulation material may result in a higher mean relative permittivity of the dielectric material (part air, part high permittivity insulation material), which will cause a decrease of impedance of the at least two electrical conductors 5.

The contact carrier 16 is also a substantially cuboid part made of an insulation material with a relative permittivity higher than air. The contact carrier 16 has a contact section 20 with a traverse cross-sectional area smaller than the protective cover 4 and a bulged section 22 with a traverse cross-sectional area equal to the protective cover 4. The contact carrier 16, in an embodiment, has a step-like transition between the contact section 20 and the bulged section 22.

The pair of electrical conductors 5, the first wire 6*a* and the second wire 6*b*, extend parallel to each other through the shielded electrical cable 10 in a transmission direction T, as shown in FIGS. 1 and 2. A circumferential direction C extends around the transmission direction T. On one end, the first wire 6*a* and the second wire 6*b* each have a terminal portion 24 protruding out of the shielded electrical cable 10 and extending into the protective cover 4 in the transmission direction T. The terminal portions 24 are spaced apart from each other. One end of each of the electrical conductors 5 protrudes from the contact carrier 16 into the material of the protective cover 4.

Figure 3:
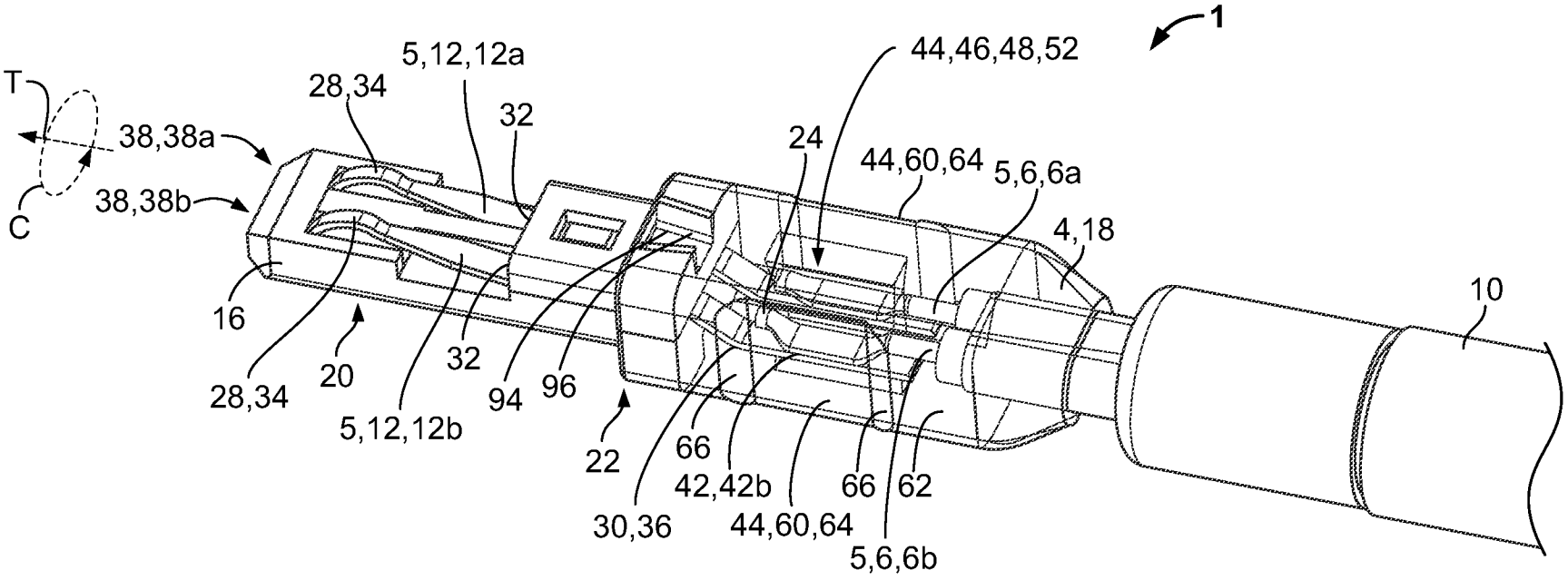
FIG. 3 is a partially transparent perspective view of a cover assembly according to another embodiment with a shielded cable.

The first contact element 12*a* and the second contact element 12*b*, as shown in FIGS. 1 to 3, extend parallel to each other through the contact carrier 16 and into the protective cover 4 opposite to the transmission direction T.

As shown in FIGS. 1 and 3, the first contact element 12*a* and the second contact element 12*b* may each be an electrically conductive spring beam 26, which flatly extends along the transmission direction T. The spring beams 26 may be positioned spaced apart from each other. Each of the spring beams 26 may comprise a contact portion 28 on a first end, a bonding portion 30 on a second end opposite the first end, and a retention portion 32 in between the contact portion 28 and the bonding portion 30. The contact portion 28 may have a curved tip 34. The curved tip 34 may be a pin-like, arc-shaped part formed integrally by the material of the corresponding spring beam 26.

The bonding portion 30, as shown in FIGS. 1 and 2, has a bonding tab 36 protruding opposite to the transmission direction T as a continuation of the spring beam 26. The bonding tab 36 may be a plate-shaped part formed integrally by the material of the corresponding spring beam 26 and fixedly embedded within the protective cover 4. The retention portion 32 may be a straight segment of the corresponding spring beam 26 fixedly retained by the contact carrier 16.

As shown in FIGS. 1 and 2, a first signal path 38*a* is jointly formed by the first wire 6*a* and the first contact element 12*a*, while a second signal path 38*b* is jointly formed by the second wire 6*b* and the second contact element 12*b*. In an embodiment, each of the signal paths 38*a*, 38*b* is configured to transmit one signal of a differential pair of signals for a high-frequency data transmission. More particularly, at a first bond location 42*a*, the terminal portion 24 of the first wire 6*a* is overlappingly bonded to the bonding tab 36 of the first contact element 12*a*, while at a second bond location 42*b*, the terminal portion 24 of the second wire 6*b*, is overlappingly bonded to the bonding tab 36 of the second contact element 12*b*. This embodiment allows for data transmission that is less prone to electromagnetic noise, due to the transmission of a differential pair of signals.

Centerlines of the pair of signal paths 38*a*, 38*b* may be parallel to each other along the entire length of the cover assembly 1. More particularly, the wire pitch of the first and second wire 6*a*, 6*b* may be equal to the contact pitch of the first and second contact element 12*a*, 12*b*. This embodiment especially prevents a spreading of the wires, which would lead to a sharp bend. Thus, at least one possible cause of signal reflection is eliminated in order to further improve signal integrity.

The first bond location 42*a* and the second bond location 42*b*, shown in FIGS. 1 to 3, each possess a traverse cross-sectional area perpendicular to the transmission direction T, which is larger than the traverse cross-sectional area of the first wire 6*a*, the second wire 6*b*, the first contact element 12*a* or the second contact element 12*b*, respectively. Therefore, the first bond location 42*a* and the second bond location 42*b* each affect the impedance of the first signal path 38*a* and the second signal path 38*b*. In addition, the first bond location 42*a* and the second bond location 42*b* are both aligned and located within the protective cover 4 to protect the bond locations 42*a*, 42*b*.

In general, impedance is the property of electrical conductors measuring their resistance against the flow of an alternating current. Impedance is influenced by several factors, such as the material and dimensions of the electrical conductor itself, by the mean relative permittivity of the medium surrounding the conductor (dielectric material), and by other electrically conductive or capacitive components in proximity of the electrical conductor, especially the relative distance between the respective surfaces.

If during the transmission of an electrical signal from a signal source to a signal receiver (load) via a transmission line, the impedance of the load and the impedance of the transmission line is not matched (impedance mismatch), signal reflection may occur. Signal reflection impairs signal integrity and is therefore an unwanted phenomenon. The cause of such an impedance mismatch and subsequent signal reflection may be a non-linear change in the cross-section of an electrical conductor of the transmission line or a discontinuity in the material surrounding the electrical conductor as well as a sharp bend in the course of the transmission line.

Due to its role as a dielectric material, the insulation material of the protective cover 4, which surrounds the first signal path 38*a* and the second signal path 38*b*, also affects the impedance of the first signal path 38*a* and the second signal path 38*b*. In order to compensate for said effects on the first bond location 42*a*, the second bond location 42*b*, and the protective cover 4, at least one impedance control structure 46 may be implemented on the protective cover 4. The impedance control structure 46 on the protective cover 4 adjusts the impedance of the at least two electrical conductors 5 to a predefined value according to the frequency of the data transmission. Thus, the effects of the bond locations 42*a*, 42*b* and of the protective cover 4 are compensated for.

Matching the impedance of the transmission line to the impedance of the load eliminates causes of impedance mismatch. The impedance of the transmission line should be adjusted to a predefined value; such a predefined value may be the impedance of the load. This compensates for at least one cause of impedance mismatch and thus reduces signal reflection. Therefore, the signal integrity of the transmitted signal is substantially improved and the reliability of the signal transmission increased.

For example, the at least one impedance control structure 46 may be at least one recess 44 locally formed on the outer surface 40 of the protective cover 4 in an area, where the first signal path 38*a* and the second signal path 38*b* are surrounded by the insulation material of the protective cover 4, while the first signal path 38*a* and the second signal path 38*b* exhibit an increased cross-section. In particular, the at least one recess 44 may result in air-filled space in said area. For this, the at least one recess 44 may be e.g. a substantially cuboid, cylindrical, conic, semi-spherical, trapezoidal or stadium-shaped cut-out in the insulation material of the protective cover 4. The cut-out may at least partly extend towards the first signal path 38*a* and/or the second signal path 38*b*. Furthermore, the cut-out may extend into another direction, preferably the transmission direction T, at least along the entire length of the first bond location 42*a* and/or the second bond location 42*b*.

Additionally or alternatively, the protective cover 4 may comprise a lead-through hole 48 as an impedance control structure 46, as shown in FIGS. 1 and 2, which extends as a substantially stadium-shaped cavity 50 through the insulation material of the protective cover 4. More particularly, the lead-through hole 48 may extend in a direction perpendicular to the transmission direction T, connecting a top surface 54 of the protective cover 4 with a bottom surface 56 of the protective cover 4. Moreover, the lead-through hole 48 may extend between the first bond location 42*a* and the second bond location 42*b*, forming an air-filled gap 58 there in between.

Figure 4:
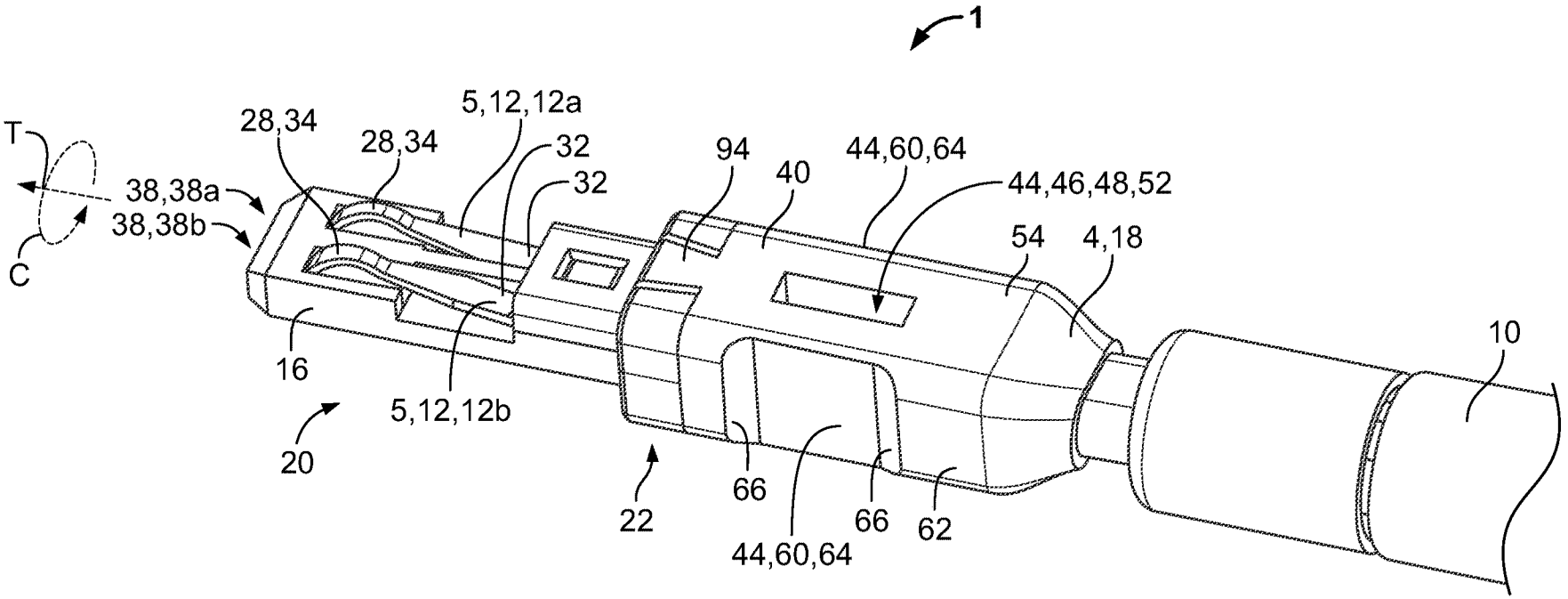
FIG. 4 is a perspective view of the cover assembly and the shielded cable of FIG. 3.

As shown in FIGS. 3 and 4, the lead-through hole 48 may alternatively extend as a substantially cuboid cavity 52 through the insulation material of the protective cover 4. In this embodiment, the lead-through hole 48 may also extend in a direction perpendicular to the transmission direction T connecting a top surface 54 of the protective cover 4 with a bottom surface 56 of the protective cover 4. Moreover, the lead-through hole 48 may extend between the first bond location 42*a* and the second bond location 42*b*, forming an air-filled gap 58 thereinbetween.

The at least one lead-through hole 48 is also an impedance control structure 46 that allows for an easy adjustment of at least one impedance-influencing factor, namely the mean relative permittivity of the dielectric material. In combination with the embodiment comprising a pair of signal paths 38*a*, 38*b*, the at least one lead-through hole 48 may extend between the pair of signal paths 38*a*, 38*b*. This way, an air-filled space may be created between the pair of signal paths 38*a*, 38*b*, which results in a lower mean relative permittivity of the dielectric material and in an increased impedance of the pair of signal paths 38*a*, 38*b*, since air has a lower relative permittivity than the insulation material. Therefore, the at least one lead-through hole 48 may be implemented in applications where the impedance of the pair of signal paths 38*a*, 38*b* needs to be increased in order to arrive at the predefined value and to compensate for the influence of the at least one bond location 42*a*, 42*b* and of the protective cover 4.

As can further be seen from FIGS. 3 and 4, the protective cover 4 may comprise a pair of lateral recesses 60 as an impedance control structure 46, which may be implemented as an addition or alternative to the lead-through hole 48. In particular, the pair of lateral recesses 60 may extend symmetrically on two opposite side surfaces 62 of the protective cover 4, in an embodiment on two side surfaces 62, which span perpendicularly between the top surface 54 and the bottom surface 56. Furthermore, each of the pair of lateral recesses 60 may extend in the transmission direction T at least along the entire length of the first bond location 42*a* and the second bond location 42*b*. Further, in a direction parallel to the lead-through hole 48, the pair of lateral recesses 60 may extend along the entire length of the lead-through hole 48.

In the embodiment shown in FIGS. 3 and 4, each of the pair of lateral recesses 60 may be a trapezoidal cut-out 64 in the insulation material of the protective cover 4, extending perpendicularly to the transmission direction T and parallel to the lead-through hole 48. In other embodiments, each of the pair of lateral recesses 60 may be a cuboid or round cut-out in the insulation material of the protective cover 4 extending perpendicularly to the transmission direction T and parallel to the lead-through hole 48. The cut-outs 64 may extend along the entire height of the respective side surfaces 62, the height being the dimension in a direction perpendicular to the transmission direction T and parallel to the lead-through hole 48. Due to the trapezoidal shape of the cut-outs 64, each of the pair of lateral recesses 60 may have two chamfered edges 66 aligned along the transmission direction T. In an embodiment, the lateral recesses 60 extend symmetrically on opposite side surfaces 62 of the protective cover 4. Each of the pair of lateral recesses 60 may extend in the transmission direction T at least along the entire length of the bond location 42*a*, 42*b*. Further, in a direction parallel to the lead-through hole 48, the at least one pair of lateral recesses 60 may extend along the entire length of the lead-through hole 48.

Figure 5:
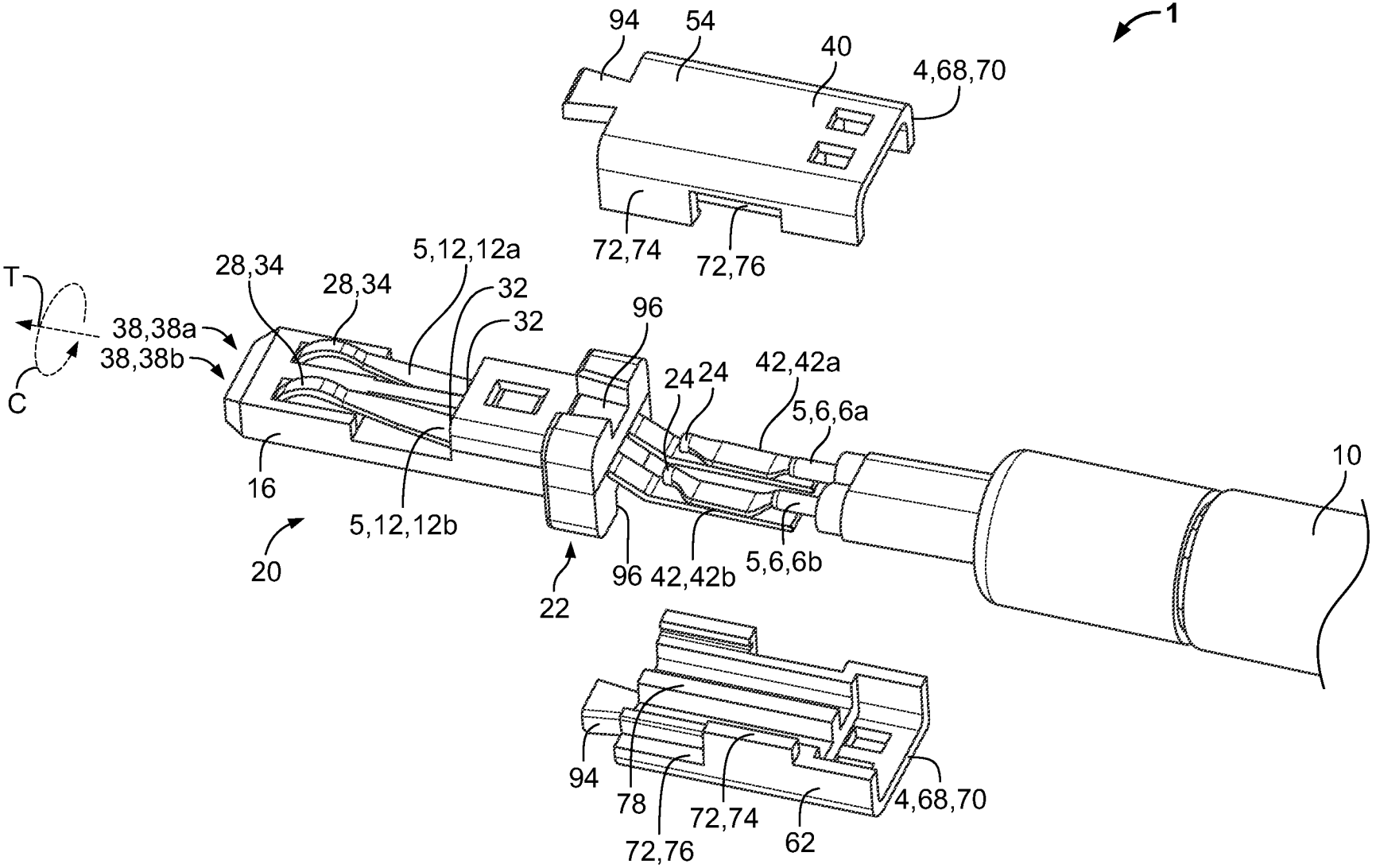
FIG. 5 is an exploded perspective view of a cover assembly according to another embodiment with a shielded cable.
Figure 6:
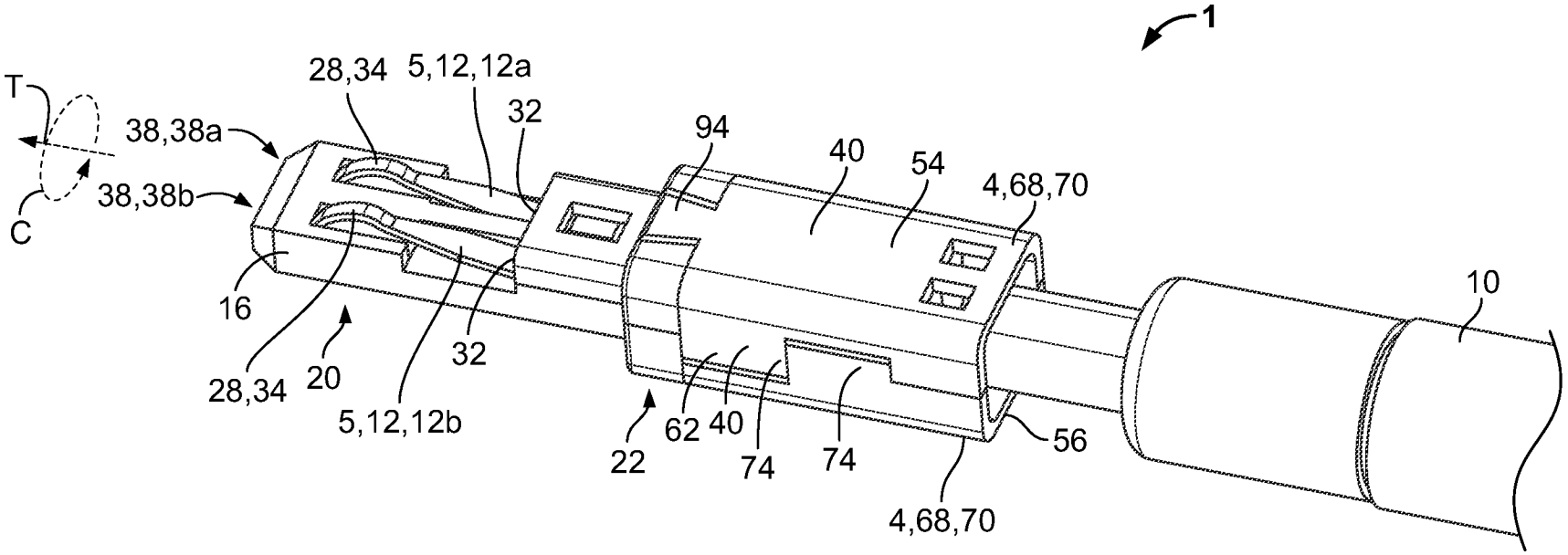
FIG. 6 is a perspective view of the cover assembly and the shielded cable of FIG. 5.

FIGS. 5 and 6 show an alternative embodiment of the protective cover 4, comprising two pieces 68 that are connected to each other to form the protective cover 4. More particularly, the protective cover 4 may be formed jointly by a pair of pre-fabricated cover halves 70 engaging in a form-fit. In the shown embodiment, the cover halves 70 are identical to each other, due to a hermaphroditic design, and have a latching mechanism 72, in that two latching cams 74 and two latching grooves 76 are arranged on each of the cover halves 70. The latching cams 74 project away from the respective cover halves 70 in a direction perpendicular to the transmission direction T and are each configured to engage in a latched connection with one of the two latching grooves 76 on the respective other cover half 70. For this, each latching groove 76 has a shape complementary to the shape of the respective latching cam 74.

The pair of cover halves 70 may comprise an impedance control structure 46 in that a high permittivity insulation material is used to form at least a part of each cover half 70. In an embodiment, an insulation material with incorporated ceramic powder may be used as a high permittivity insulation material.

Each of the pair of cover halves 70 may further comprise an inner wall 78, at least partly spacing apart the first signal path 38*a* from the second signal path 38*b*. The inner wall 78 may also be formed in the overmolded part 18, as can be seen in FIGS. 1 to 4.

Figure 7:
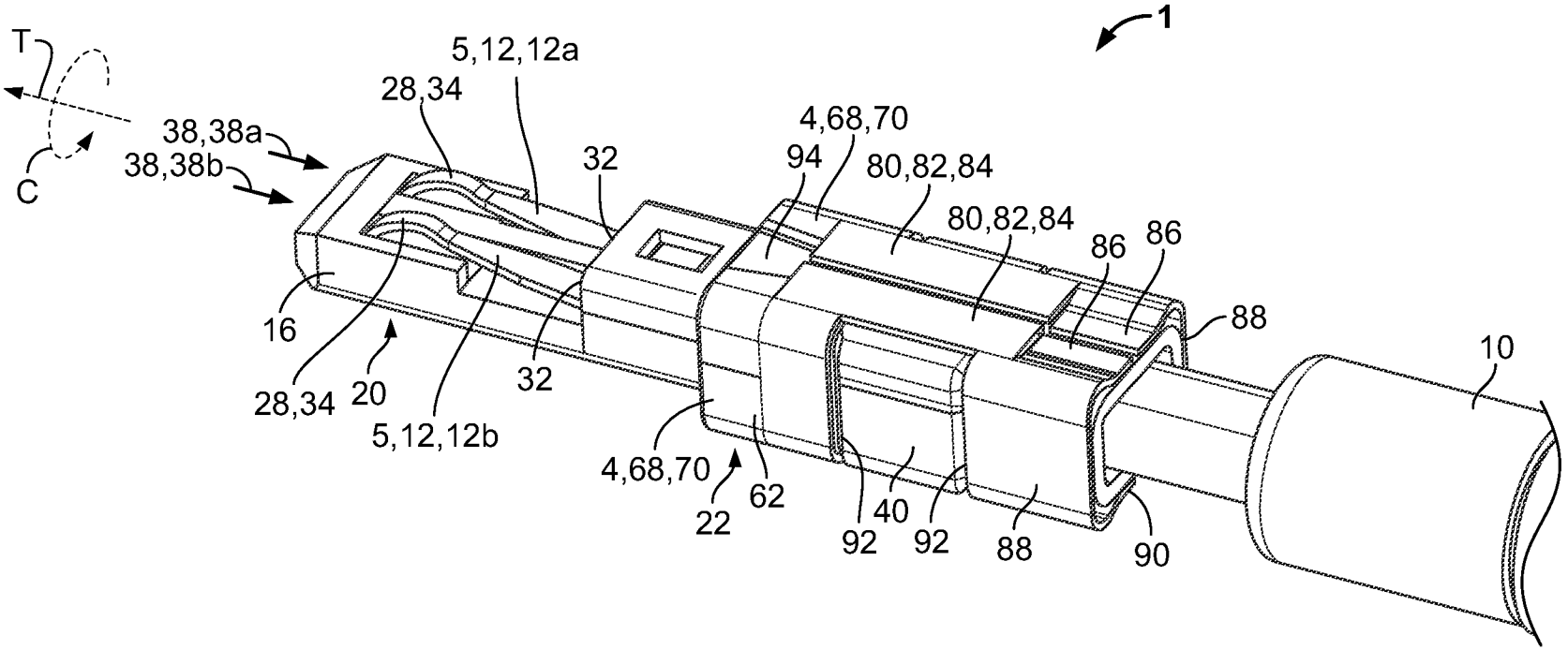
FIG. 7 is a perspective view of a cover assembly according to another embodiment with a shielded cable.

FIG. 7 shows another possible embodiment of an impedance control structure 46, in that the pair of pre-fabricated cover halves 70 is surrounded by two capacitive elements 80. More particularly, the two capacitive elements 80 are two metal clips 82, each made from a bent sheet metal part 84. The metal clips each comprise a top plate 86, a middle plate 88, and a bottom plate 90 arranged in a U-shaped manner. The top plate 86 and the bottom plate 90 abut against the pair of pre-fabricated cover halves 70 and are in direct contact therewith. The middle plate 88 may be split into at least two segments, which are embedded into corresponding holding grooves 92 on the side surfaces 62 of the pair of pre-fabricated cover halves 70.

Alternatively, the capacitive elements 80 may be separate metal plates positioned into holding grooves 92 on at least one outer surface of the protective cover 4, or glued thereto. Furthermore, the capacitive elements 80 may be woven metal parts surrounding the pair of pre-fabricated cover halves 70.

The at least one capacitive element 80 is an impedance control structure 46 that allows for an adjustment of at least one impedance-influencing factor, namely the relative distance between the surfaces of the at least two electrical conductors 5 and the surface of the at least one capacitive element 80. In particular, said relative distance is shortened by positioning the at least one capacitive element 80 on the surface of the protective cover 4 and thus in proximity of the at least two electrical conductors 5. As a result, the impedance of the at least two electrical conductors 5 is lowered. Subsequently, the at least one capacitive element 80 may be utilized in applications where the impedance of the at least two electrical conductors 5 needs to be reduced in order to arrive at the predefined value, and to compensate for the influence of the at least one bond location 42*a*, 42*b* and of the protective cover 4. This could be the case, for example, in areas where the at least two electrical conductors 5 are surrounded by air, e.g. due to air-filled gaps in the protective cover 4 caused be manufacturing inaccuracies Any of the above-mentioned embodiments of the at least one impedance control structure 46 may be aligned with the at least one bond location 42*a*, 42*b*. More particularly, the at least one impedance control structure 46 may be in the vicinity of and/or locally limited to the area of influence of the at least one bond location 42*a*, 42*b*, thus concentrating and maximizing the effect of the at least one impedance control structure 46.

As can be seen from FIGS. 1 to 7, the contact carrier 16 and the protective cover 4 may be positioned adjacently to each other in the transmission direction T, and engage in a form-fit. For this, the protective cover 4 may comprise two tabs 94 protruding away from the protective cover 4 towards the contact carrier 16. The contact carrier 16 may comprise two complementarily-shaped slots, each configured to receive one of the two tabs 94 of the protective cover 4. The allocation of the tabs 94 and slots 96 may also be inverted, in that the contact carrier 16 comprises the tabs 94, and the protective cover 4 comprises the slots 96. In another embodiment, the contact carrier 16 may be integrally formed with the protective cover 4.

FIG. 8 shows a sectional view of a connector 2 for high-frequency data transmission comprising the cover assembly 1 and a terminal shield 98, wherein the protective cover 4 and the contact carrier 16 of the cover assembly 1 are located within the terminal shield 98. The terminal shield 98 has one insertion opening 100 for receiving a mating connector 102.

The connector 2 shown in FIG. 8 may further be connected to a shielded electrical cable 10, such as through a crimping connection. For this, the terminal shield 98 may further comprise a crimping portion 104 on an end opposite to the insertion opening 100. The crimping portion 104 may be formed as an integral part of the terminal shield 98, and may extend coaxially with the shielded electrical cable 10. Furthermore, the crimping portion 104 may be wrapped around the shielded electrical cable in a circumferential direction C, as can be seen from FIGS. 8 and 9.

In FIG. 10, the result of providing a first contact element 12*a* in a 360° accessible orientation and providing a second contact element 12*b* in a 360° accessible orientation according to one embodiment of the method, disclosed in the present invention, is shown. The first contact element 12*a* and the second contact element 12*b* are provided in a 360° accessible orientation, in that the bonding tab 36 of the first contact element 12*a* and the bonding tab 36 of the second contact element 12*b* freely protrude away from the contact carrier 16.

In FIG. 11, the result of providing a first wire 6*a* in a 360° accessible orientation and providing a second wire 6*b* in a 360° accessible orientation, according to one embodiment of the method disclosed in the present invention, is shown. The first wire 6*a* and the second wire 6*b* are provided in a 360° accessible orientation, in that the terminal portion 24 of the first wire 6*a* and the terminal portion 24 of the second wire 6*b* freely protrude away from the shielded electrical cable 10.

In FIG. 12, the preparations for the step of surrounding the first signal path 38*a* and the second signal path 38*b* with a cast 106, according to one embodiment of the method disclosed in the present invention, are shown. In particular, the terminal portion 24 of the first wire 6*a* is overlappingly bonded to the bonding tab 36 of the first contact element 12*a* at the first bond location 42*a*. The terminal portion 24 of the second wire 6*b* is overlappingly bonded to the bonding tab 36 of the second contact element 12*b* at the second bond location 42*b*.

Further, in FIG. 12, the cast 106 comprising two mold halves 108*a*, 108*b*, two cores 110, and a blade 112 is shown ready to surround the first bond location 42*a* and the second bond location 42*b*. In particular, the blade 112 may be inserted between the first bond location 42*a* and the second bond location 42*b*. The blade 112 may be positioned on one of the two cores 110, which fixate the first bond location 42*a* and the second bond location 42*b* from two opposite directions, perpendicular to the transmission direction T. The two cores 110 and the blade 112 may possess a combined shape, which corresponds to the negative shape of the lead-through hole 48. Thus, the two cores 110 and the blade 112 may jointly form the lead-through opening 48 in the insulation material of the protective cover 4.

FIG. 1 shows the result of removing the cast 106 after the hardening of the injected insulation material. More particularly, insulation material is injected into the cast 106, surrounding the first bond location 42*a* and second bond location 42*b*. After the hardening of the injected insulation material, the cast 106 is removed, resulting in the protective cover 4 being formed as an overmolded part 18 with at least one impedance control structure 46, namely the lead-through hole 48.

A method for overmolding a bond 42*a*, 42*b* between at least one wire 6 of a cable 10 and at least one contact element 12 with a protective cover 4 made of insulation material, comprises steps of providing the at least one contact element 12; providing the at least one wire 6; positioning the at least one contact element 12 and the at least one wire 6 in a partially overlapping position; bonding the at least one contact element 12 and the at least one wire 6 e.g. by welding, such as by compaction welding and/or resistive welding or alternatively by similar appropriate methods such as soldering, brazing, etc.; surrounding the bonds 42 with the cast 106, the cast 106 having at least one core 110, which forms the at least one impedance control structure 46 in the insulation material; injecting the insulation material into the cast 106; and removing the cast 106 and the at least two cores 110 after the hardening of the injected insulation material.

This method allows the manufacturing of the protective cover 4 as the overmolded part 18, thus proving a means for reliably transmitting high-frequency signals, in particular in the gigahertz range. Simultaneously, this method allows forming the at least one impedance control structure 46 in the insulation material of the protective cover 4. It therefore shortens the time for manufacturing of the overmolded protective cover 4.

The above described method may be further improved by adding one or more of the following optional steps. Hereby, each of the following optional steps is advantageous on its own, and may be combined independently with any other optional step.

In a first embodiment, the method may comprise the steps of providing the at least one contact element 12 in a 360° accessible orientation as shown in FIG. 10; and providing the at least one wire 6 in a 360° accessible orientation, as shown in FIG. 11. By providing the at least one contact element 12 and the at least one wire 6 in a 360° accessible orientation, it is possible to implement a resistive welding process, wherein the at least one contact element 12 and the at least one wire 6 may be overlappingly placed between two ceramic spacers and pinched between two electrodes, which establish an electrical current in and a mechanical force on the overlapping at least one contact element 12 and at least one wire 6. Such a resistive welding process exhibits short cool-down periods and thus increases productivity. It also may be realized in small scale applications, thus enabling miniaturized design.

In another embodiment, the method may comprise the steps of providing a first contact element 12*a*; providing a second contact element 12*b*; providing a first wire 6*a*; providing a second wire 6*b*; positioning the first contact element 12*a* and the first wire 6*a* in a partially overlapping position, to form a first signal path 38*a*; and positioning the second contact element 12*b* and the second wire 6*b* in a partially overlapping position, to form a second signal path 38*b*.

In yet another embodiment the method may comprise the steps of fixating the first and second signal path 38*a*, 38*b* with at least two cores 110 from at least two opposite directions, such as two opposite directions perpendicular to the transmission direction T.

According to another embodiment, the method may comprise the steps of inserting a blade 112 between the first and second signal path 38*a*, 38*b*, the blade 112 being an integral part of one of the at least two cores 110. The blade 112 may function as an additional or alternative spacer between the first and second signal path 38*a*, 38*b*, further preventing an unwanted movement of the first and second signal path 38*a*, 38*b* during the injection of the insulation material. The blade 112 thus may further increase the reliability of the overmolding process. Moreover, a combination of the at least two cores 110 and the blade 112 allows for the manufacturing of the overmolded protective cover 4 itself, while simultaneously forming the at least one lead-through hole 48 as an impedance control structure 46 in the insulation material of the protective cover 4.

What is claimed is:

1. A cover assembly, comprising:

a protective cover having an impedance control structure;

a plurality of electrical conductors conducting electrical signals of a high-frequency data transmission, the electrical conductors extend through the protective cover in a transmission direction and are overlappingly bonded to each other at a bond location located within the protective cover, the impedance control structure adjusts an impedance of the bond location to a predefined value; and a contact carrier supporting at least one of the electrical conductors, an end of the at least one electrical conductor protrudes from the contact carrier into the protective cover.

2. The cover assembly of claim 1, wherein one of the electrical conductors is a wire and a shielded cable and another of the electrical conductors is a contact element having a pin-like shape, the wire and the contact element jointly form a signal path for transmission of data.

3. The cover assembly of claim 1, wherein the electrical conductors include a first wire, a second wire, a first contact element, and a second contact element.

4. The cover assembly of claim 3, wherein the first wire and the first contact element form a first signal path and the second wire and the second contact element form a second signal path, the first signal path and the second signal path are a pair of signal paths.

5. The cover assembly of claim 4, wherein a centerline of each of the signal paths run parallel to each other along an entire length of the cover assembly.

6. The cover assembly of claim 4, wherein the impedance control structure is a lead-through hole in the protective cover that extends between the pair of signal paths.

7. The cover assembly of claim 1, wherein the protective cover is overmolded over the bond location and made from an insulation material.

8. The cover assembly of claim 1, wherein the protective cover has a pair of pieces connected to each other to form the protective cover.

9. The cover assembly of claim 1, wherein the impedance control structure is a recess on an outer surface of the protective cover.

10. The cover assembly of claim 1, wherein the impedance control structure is a lateral recess on a side surface of the protective cover.

11. The cover assembly of claim 1, wherein the impedance control structure is a capacitive element positioned on an outer surface of the protective cover.

12. The cover assembly of claim 1, wherein the impedance control structure is in a high permittivity insulation material of the protective cover.

13. The cover assembly of claim 1, wherein the impedance control structure is aligned with the bond location.

14. A connector, comprising:

a cover assembly including a protective cover having an impedance control structure and a plurality of electrical conductors conducting electrical signals of a high-frequency data transmission, the electrical conductors extend through the protective cover in a transmission direction and are overlappingly bonded to each other at a bond location located within the protective cover, the impedance control structure adjusts an impedance of the bond location to a predefined value;

a terminal shield having an insertion opening receiving a mating connector; and a contact carrier supporting at least one of the electrical conductors, an end of the at least one electrical conductor protrudes from the contact carrier into the protective cover, the protective cover and the contact carrier are disposed within the terminal shield.

15. A method for overmolding with an insulation material a bond between a contact element and a wire of a cable, comprising:

providing the contact element;

providing the wire;

positioning the contact element and the wire in a partially overlapping position;

bonding the contact element and the wire at a bond;

surrounding the bond with a cast including a core;

injecting the insulation material into the cast; and removing the cast and the core after the insulation material hardens, the core forms an impedance control structure in the insulation material.

* * * * *